US008333184B2

(12) United States Patent
Gallo

(10) Patent No.: US 8,333,184 B2
(45) Date of Patent: Dec. 18, 2012

(54) COOL TOUCH FIREPLACE

(75) Inventor: Christopher J. Gallo, North Canton, OH (US)

(73) Assignee: Heat Surge, LLC, Canton, OH (US)

( * ) Notice: Subject to any disclaimer, the term of this patent is extended or adjusted under 35 U.S.C. 154(b) by 444 days.

(21) Appl. No.: 12/683,798

(22) Filed: Jan. 7, 2010

(65) Prior Publication Data

US 2011/0162636 A1 Jul. 7, 2011

(51) Int. Cl.
*F24B 1/188* (2006.01)

(52) U.S. Cl. ..... 126/523; 126/507; 126/533; 126/509; 454/275; 454/283; 454/286; 454/358

(58) Field of Classification Search ..... 126/507, 126/533, 523, 509; 285/345; 454/275, 283, 454/286, 358
See application file for complete search history.

(56) References Cited

U.S. PATENT DOCUMENTS

| | | | | | |
|---|---|---|---|---|---|
| 2,132,563 | A * | 10/1938 | Gallup | 126/531 |
| 2,338,316 | A * | 1/1944 | Buzzell | 174/83 |
| 2,724,321 | A * | 11/1955 | Kagan | 454/265 |
| 2,859,742 | A * | 11/1958 | Ruhl | 126/92 AC |
| 3,400,755 | A * | 9/1968 | Banta | 165/178 |
| 3,512,805 | A * | 5/1970 | Glatz | 285/109 |
| 3,636,307 | A * | 1/1972 | Pearce | 392/363 |
| 3,724,357 | A * | 4/1973 | Kavthekar et al. | 454/152 |
| 3,930,490 | A * | 1/1976 | Lassy et al. | 126/522 |
| 4,008,704 | A * | 2/1977 | Petrie | 126/522 |
| 4,099,749 | A * | 7/1978 | van Vliet | 285/398 |
| 4,112,914 | A * | 9/1978 | Brown | 126/502 |
| 4,129,113 | A * | 12/1978 | Bergstrom | 126/522 |
| 4,159,673 | A * | 7/1979 | Weirich | 454/260 |
| 4,179,821 | A * | 12/1979 | Herbst et al. | 34/235 |
| 4,368,894 | A * | 1/1983 | Parmann | 277/615 |
| 4,773,197 | A * | 9/1988 | Sullivan | 52/220.1 |
| 4,787,365 | A * | 11/1988 | Coleman | 126/521 |
| 5,226,682 | A * | 7/1993 | Marrison et al. | 285/308 |
| 5,318,328 | A * | 6/1994 | Dawson | 285/9.1 |
| 5,383,688 | A * | 1/1995 | Berry | 285/49 |
| 5,584,129 | A * | 12/1996 | Williamson | 34/235 |
| 5,709,415 | A * | 1/1998 | Witter | 285/304 |
| 5,716,270 | A * | 2/1998 | Chambers | 454/332 |
| 5,722,181 | A * | 3/1998 | Meyer | 34/235 |
| 5,904,137 | A * | 5/1999 | Salley | 126/522 |
| 5,916,023 | A * | 6/1999 | Meyer | 454/359 |
| 6,302,788 | B1 * | 10/2001 | Gagnon | 454/367 |
| 6,511,253 | B1 * | 1/2003 | Grimes et al. | 403/327 |
| 6,521,072 | B1 * | 2/2003 | Campbell | 156/158 |
| 6,968,123 | B2 * | 11/2005 | Ravnbo-West et al. | 392/348 |
| 6,994,622 | B2 * | 2/2006 | Koessler | 454/367 |
| 2001/0048223 | A1 * | 12/2001 | Campbell | 285/21.1 |
| 2003/0156828 | A1 * | 8/2003 | Jamieson et al. | 392/348 |
| 2006/0138146 | A1 * | 6/2006 | Earnhart et al. | 220/366.1 |
| 2006/0163099 | A1 * | 7/2006 | McGovern et al. | 206/407 |

FOREIGN PATENT DOCUMENTS

| | | | |
|---|---|---|---|
| CN | 1797505 | A * | 7/2006 |
| JP | 11051457 | A * | 2/1999 |

* cited by examiner

*Primary Examiner* — Kenneth Rinehart
*Assistant Examiner* — Jorge Pereiro
(74) *Attorney, Agent, or Firm* — Sand & Sebolt

(57) ABSTRACT

A fireplace including a body, a heating unit within the body, a duct within the body and in communication with the heating unit, an opening defined by a terminal end of the duct, an insert attached to the terminal end of the duct and arranged to dispel a heated air, and wherein the insert remains at a lower temperature than the duct during a heating operation.

18 Claims, 12 Drawing Sheets

COOL TOUCH FIREPLACE

BACKGROUND OF THE INVENTION

1. Technical Field

The invention relates generally to an electric fireplace which can be mounted within cabinetry. More particularly, the invention relates to an aesthetically pleasing electric fireplace with safety devices to protect users near the fireplace. Specifically, the invention relates to an electric fireplace with a heat resistant insert and limited access to the heating unit to prevent burns and other physical injury.

2. Background Information

Fireplaces are a common way of providing heat within the home. However, the installation of a fireplace requires substantial investment in the home as well as planning during construction or significant remodeling. Further, once the fireplace is installed, the look and feel of the room is difficult to change since the fireplace cannot be moved.

In an effort to remedy the concerns of providing heat along with the maneuverability of a portable fireplace, electric fireplaces have been developed. The electric fireplace provides the appearance and heat of a traditional fireplace with the additional benefit of being portable. Since the fireplace is portable, the fireplace can be moved from room to room or repositioned within a room with very little effort.

While electric fireplaces provide portable heat, they are also potentially hazardous for small children. A ceramic style heater may incorporate ceramic plates and aluminum baffles so that when electricity passes through the ceramic plates, resistance and heat is created. An electric fan then passes ambient air over the heated ceramic plates and aluminum baffles to heat the area proximate the heater. Because the ceramic plates and aluminum baffles use electricity to provide heat, they provide a potential risk of electrocution or burning.

Another major concern when operating an electric fireplace is the heat exiting the unit. The heated air exiting the fireplace can be well over 200 degrees Fahrenheit and tends to quickly heat any surrounding material. The higher temperatures mean that the exhaust ductwork and any objects adjacent the heated air outlet will become hot to the touch during the fireplace's operation.

A number of electric fireplaces utilize louvers to cover the heated air outlets for aesthetic purposes while still permitting airflow. Although the louvers permit airflow, they also block approximately 20 percent of the airflow. The louvers also tend to become very hot because they are in close proximity to the heated air exiting the fireplace. Consequently, a user can be burned by touching the louvers when the fireplace is in operation.

BRIEF SUMMARY OF THE INVENTION

The present invention broadly comprises a fireplace including a body, a heating unit within the body, a duct within the body and in communication with the heating unit, an opening defined by a terminal end of the duct, an insert attached to the terminal end of the duct and arranged to dispel a heated air, and wherein the insert remains at a lower temperature than the duct during a heating operation.

The present invention also broadly comprises a fireplace including a body, a heating unit within the body, a duct within the body and in communication with the heating unit, an opening defined by a terminal end of the duct, an insert attached to the terminal end of the duct and arranged to dispel a heated air, wherein the insert remains at a lower temperature than the duct during a heating operation, wherein the heating unit rests on a platform within the body and the heating unit is located above the opening, and wherein the duct is angled downward from the heating unit to the opening.

The present invention also broadly comprises a fireplace including a body, a heating unit within the body, a duct within the body and in communication with the heating unit, an opening defined by a terminal end of the duct, an insert attached to the terminal end of the duct and arranged to dispel a heated air, wherein the insert remains at a lower temperature than the duct during a heating operation, and the insert is rotatable in two opposite directions.

BRIEF DESCRIPTION OF THE SEVERAL VIEWS OF THE DRAWINGS

A preferred embodiment of the invention, illustrative of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
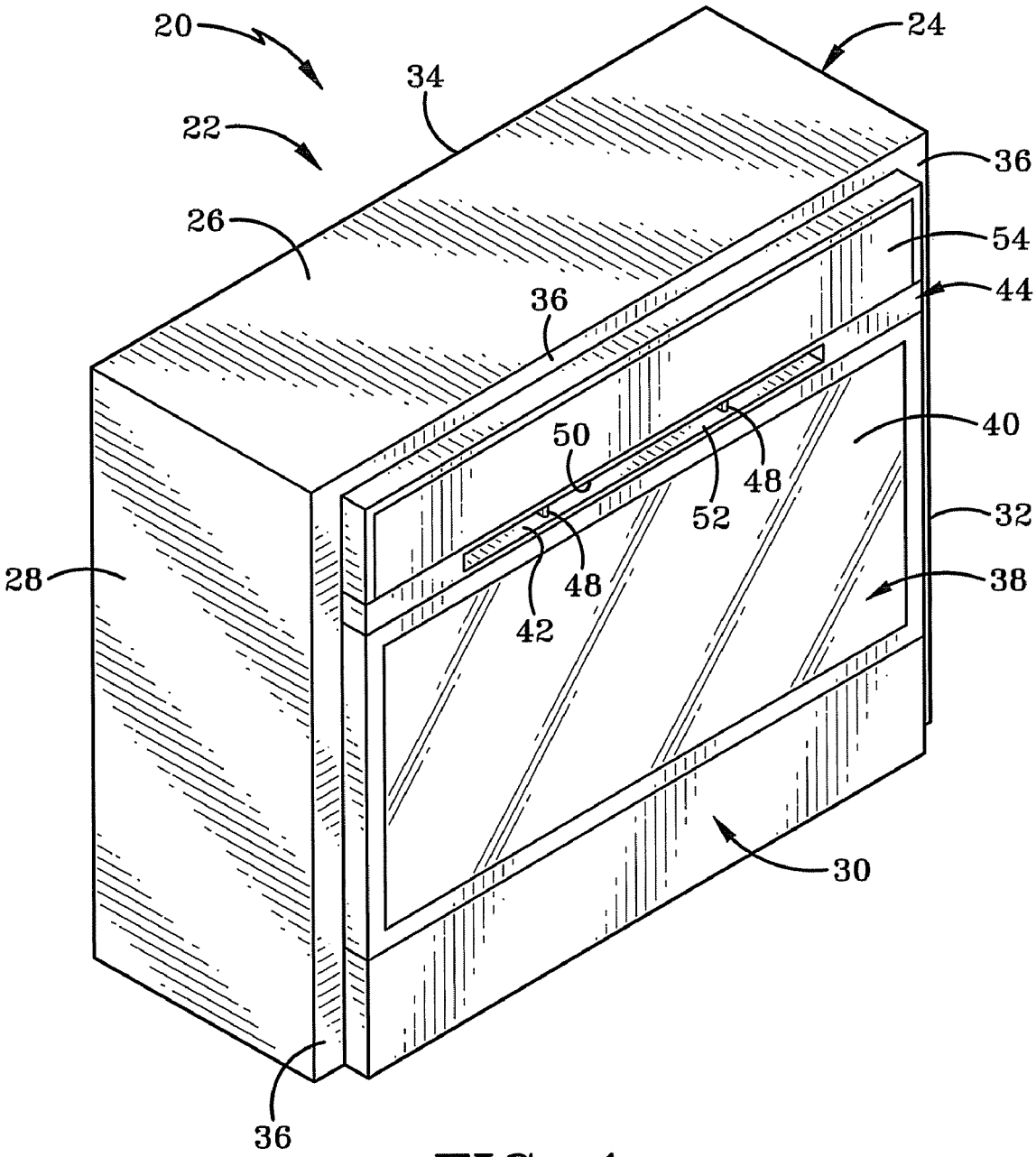
FIG. 1 is a perspective view of a first preferred embodiment fireplace with the heated air outlet extending for approximately two-thirds of the width of the fireplace.

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices and materials are now described.

A fireplace assembly of the present invention is indicated generally at 20, as is particularly shown in FIGS. 1-13. As particularly shown in FIGS. 1 through 5, a first preferred embodiment fireplace assembly 22, a housing 24 having a top wall 26, a left side wall 28, a front wall 30, a right side wall 32, and a back wall 34. Front wall 30 preferably includes a recessed perimeter 36 to permit front wall 30 to fit flush within a cabinet or other decorative structure (not shown). Front wall 30 also preferably includes a fire display 38 with a glass cover 40 flush with the front wall.

In accordance with one of the main features of the present invention, front wall 30 includes an opening 42 located within an insert 44. Opening 42 is in communication with a duct 46 and permits heated air to exit the fireplace. Insert 44 may also include a pair of vertically oriented supports 48 connecting a ceiling 50 and a floor 52 of the insert. In a preferred embodiment, opening 42 has a width and height sufficient to pass heated air into the room and may be angled from narrow to wide to decrease the velocity of the exiting air. Opening 42 may be any suitable length, so long as the combined length and width of the opening are adequate to pass the heated air. For example, opening 42 may encompass only one-half or two-thirds of the insert's width. Insert 44 is preferably composed of a plastic or other composite material that is impact resistant but does not absorb heat.

Figure 2:
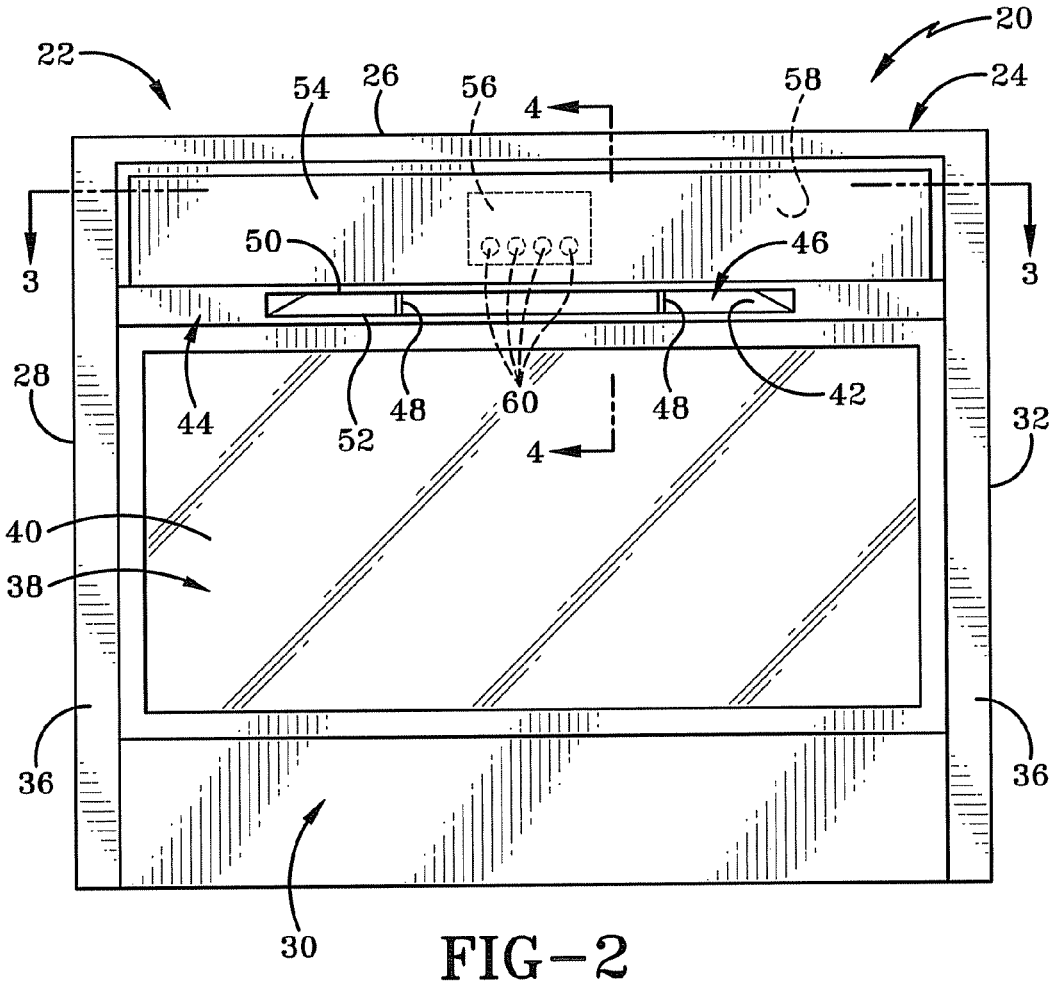
FIG. 2 is a front plan view of the first preferred embodiment fireplace illustrating a control panel in dashed lines behind an access panel.

FIG. 2 illustrates an access panel 54 in the dosed position and containing a control panel 56 within a cavity 58. Control panel 56 preferably includes a plurality of buttons 60 for controlling the temperature and speed of the heated air as well as the appearance of fire display 38.

Figure 3:
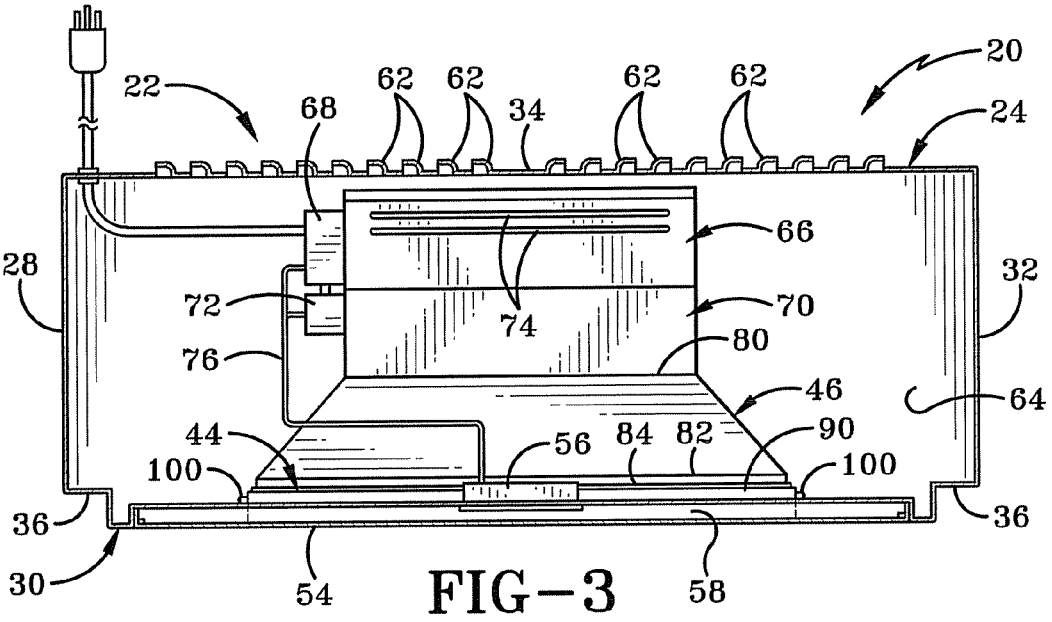
FIG. 3 is a top partial cross-sectional view of the first preferred embodiment fireplace taken generally along line 3-3 in FIG. 2.

FIG. 3 is a top cross-sectional view of electric fireplace 22 and illustrating intake ports 62 in back wall 34. A housing cavity 64, formed by walls 26, 28, 30, 32, and 34, contains a blower assembly 66 with a blower 67 and a blower motor 68, and a heater 70 with heater coil 72. Blower assembly 66 includes slots 74 adapted to permit ambient air to pass into the blower assembly. Further, control panel 56 controls the temperature and air speed through wiring 76 in communication with blower motor 68 and heater coil 72.

Figure 4:
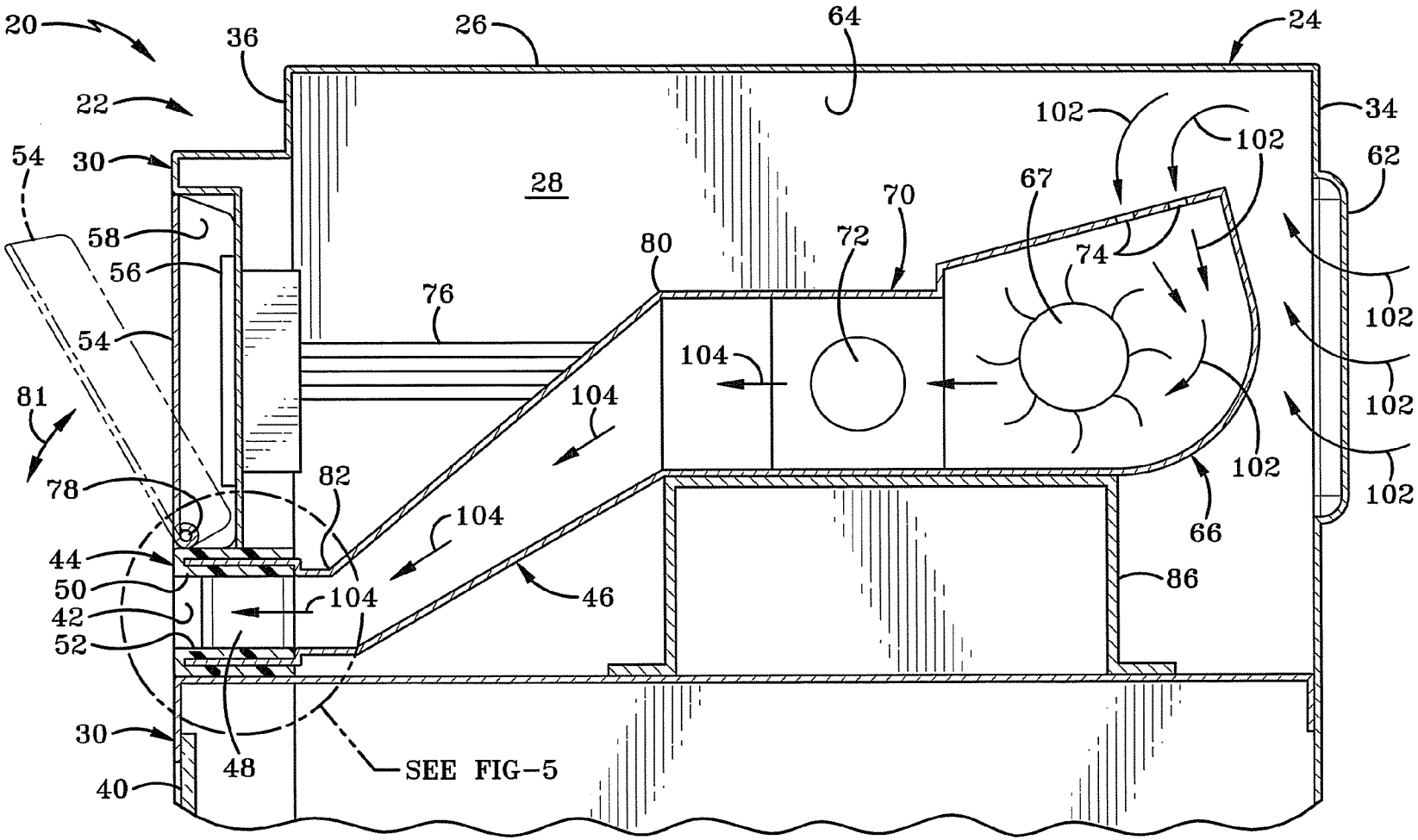
FIG. 4 is a cross-sectional view of a preferred embodiment fireplace taken generally along line 4-4 in FIG. 2 and illustrating a first preferred embodiment air flow path and the operation of the access panel.

FIG. 4 illustrates the process for heating ambient air and the operation of access panel 54. Access panel 54 preferably pivots about pins 78 in the direction associated with arrows 81 and may be closed with a magnet near the top of the access panel (not shown). Further, the magnet may be a push and release style, where the magnet extends outward when depressed to permit the user to grasp and pivot the access panel in the direction associated with arrows 81.

In accordance with another main feature of the present invention, duct 46 is preferably angled downward from a back end 80 to a front end 82. Duct 46 may also include a step 84 proximate front end 82. Advantageously, the angle of duct 46 prevents objects from being inserted into the duct and contacting heater coil 72. In order to accommodate the angle of duct 46, heater 70 and blower assembly 66 preferably rest on platform 86 with a height approximately equal to the height of duct 46. Thus, the height of platform 86 must increase or decrease as the angle and length of duct 46 increase or decrease in the first preferred embodiment.

Figure 5:
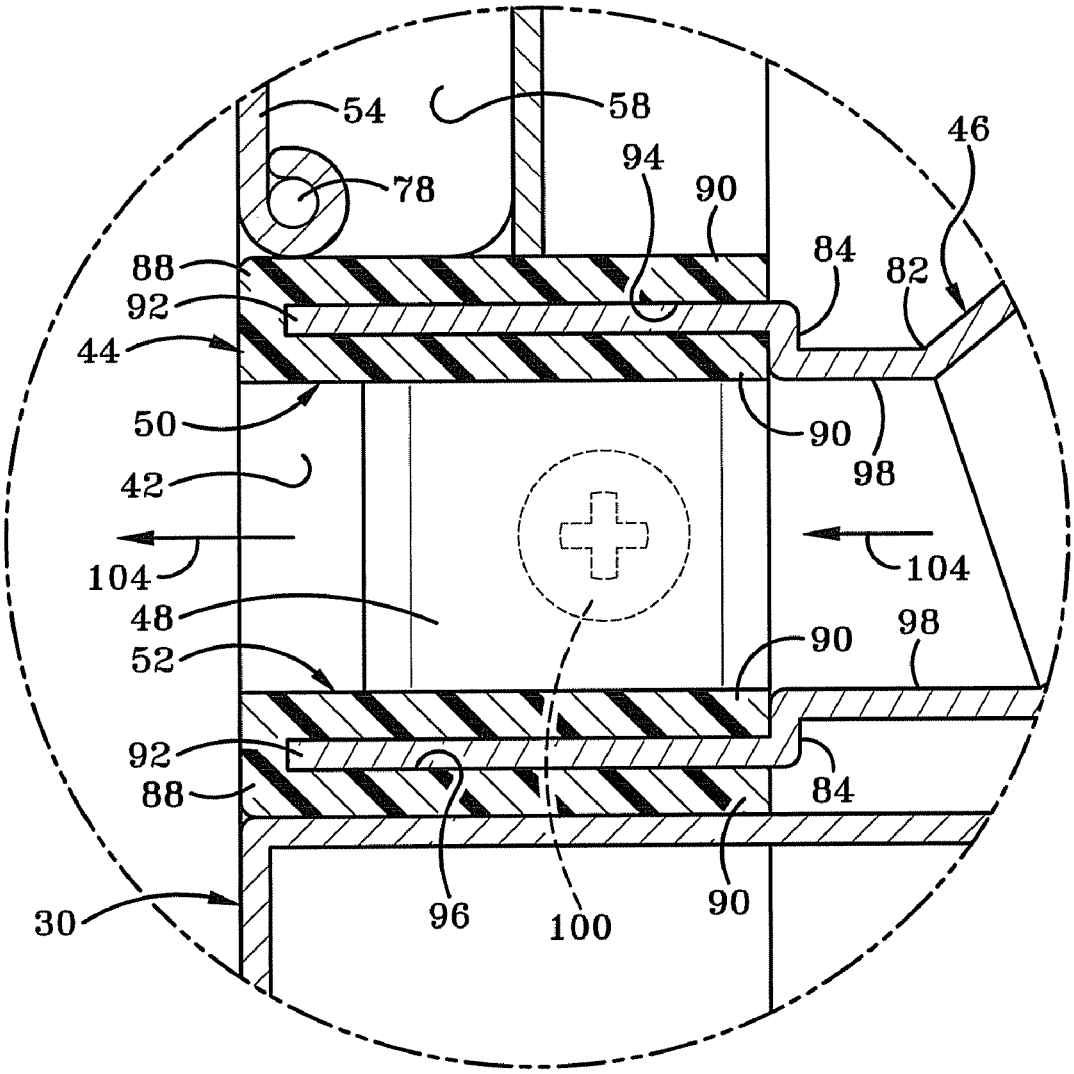
FIG. 5 is an enlarged view of the encircled region labeled Fig-5 in FIG. 4 and illustrating a preferred embodiment insert secured to the outlet duct.

Referring now to FIG. 5 and in accordance with still another main feature of the present invention, insert 44 and opening 42 are shown in greater detail. Insert 44 includes an outer end 88 and an inner end 90. Outer end 88 is preferably U-shaped and surrounds a terminal end 92 of duct 46. Inner ends 90 define a space 94 proximate insert ceiling 50 adapted to receive terminal end 92 of duct 46 and abut step 84 at the top. Similarly, inner ends 90 also define a space 96 proximate insert floor 52 adapted to receive terminal end 92 of duct 46 and abut step 84 at the bottom. Proximate and internal of step 84, duct 46 includes a flat surface 98 which at least partially defines the heated air outlet. Opening 42, and specifically insert ceiling 50 and insert floor 52, is flush with flat surface 98 to insure a steady flow of air during operation. Finally, insert 44 is removably secured within duct 46 by a screw 100 or any suitable fastener without departing from the spirit and scope of the present invention as claimed.

Referring back to FIG. 4, the operation of the fireplace will now be described. Ambient air 102 enters intake ports 62 and is directed into blower assembly 66 through slots 74. Next, blower 67 forces the ambient air 102 over heater coil 72. Heater coil 72 is preferably a resistively heated coil, but may also be any suitable heating element. Heated air 104 is then directed through duct 46 in a generally downward direction and finally passes through duct front end 82 and opening 42 of insert 44. Advantageously, heated air 104 exits opening 42 and warms the area around the fireplace while insert 44 remains cool to the touch.

Having described the structure and operation of the first embodiment, a second embodiment will now be described in greater detail. Similar numerals refer to similar parts throughout the various embodiments.

Figure 2A:
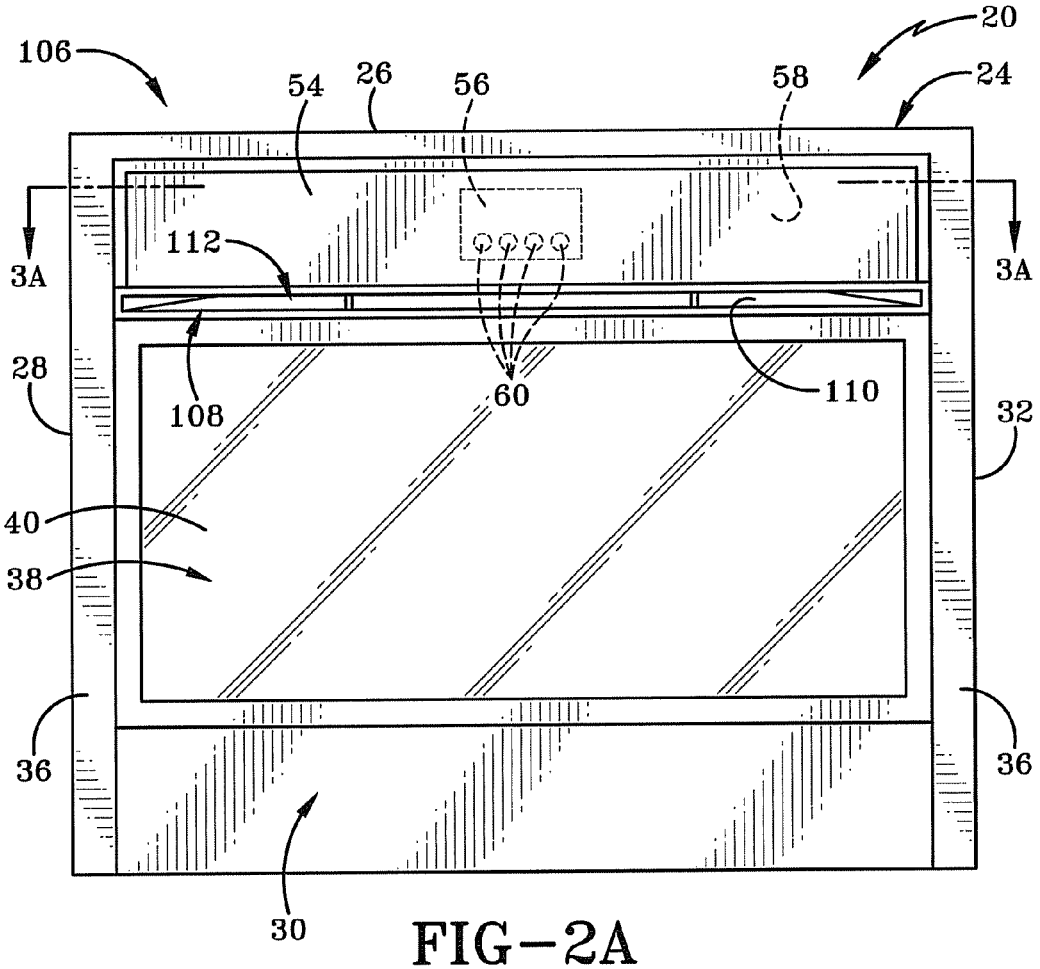
FIG. 2A is a front plan view of a second preferred embodiment fireplace with the heated air outlet extending for approximately the full width of the fireplace and a control panel in dashed lines behind an access panel.
Figure 3A:
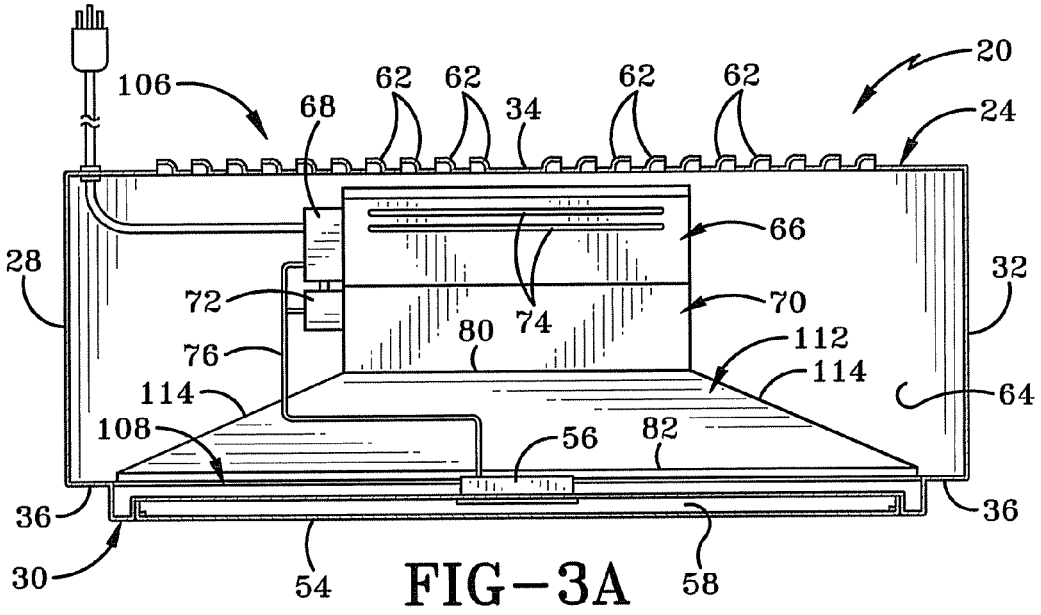
FIG. 3A is a top partial cross-sectional view of the second preferred embodiment fireplace taken generally along line 3A-3A in FIG. 2A.

Referring to FIGS. 2A and 3A, a second embodiment fireplace 106 is illustrated with an insert 108, having an opening 110, and a duct 112. Insert 108 and duct 112 are similar to the first embodiment, except that opening 110 extends for approximately the entire width of front wall 30 and is slightly shorter, while duct 112 is also wider. Due to the fact that duct 112 of the second preferred embodiment is wider than the duct of the first preferred embodiment, the duct may have side walls 114 angled more severely back towards heater 70 and blower assembly 66. The second preferred embodiment fireplace may provide a more aesthetically pleasing appearance that some consumers may find more appealing. Thus, the second preferred embodiment fireplace incorporates an insert 108 with a wider and narrower opening 110 that functions identical to the first preferred embodiment fireplace.

Having described the structure and operation of the first two preferred embodiments, a third preferred embodiment will now be described in greater detail. Similar numerals refer to similar parts throughout the various embodiments.

Figure 6:
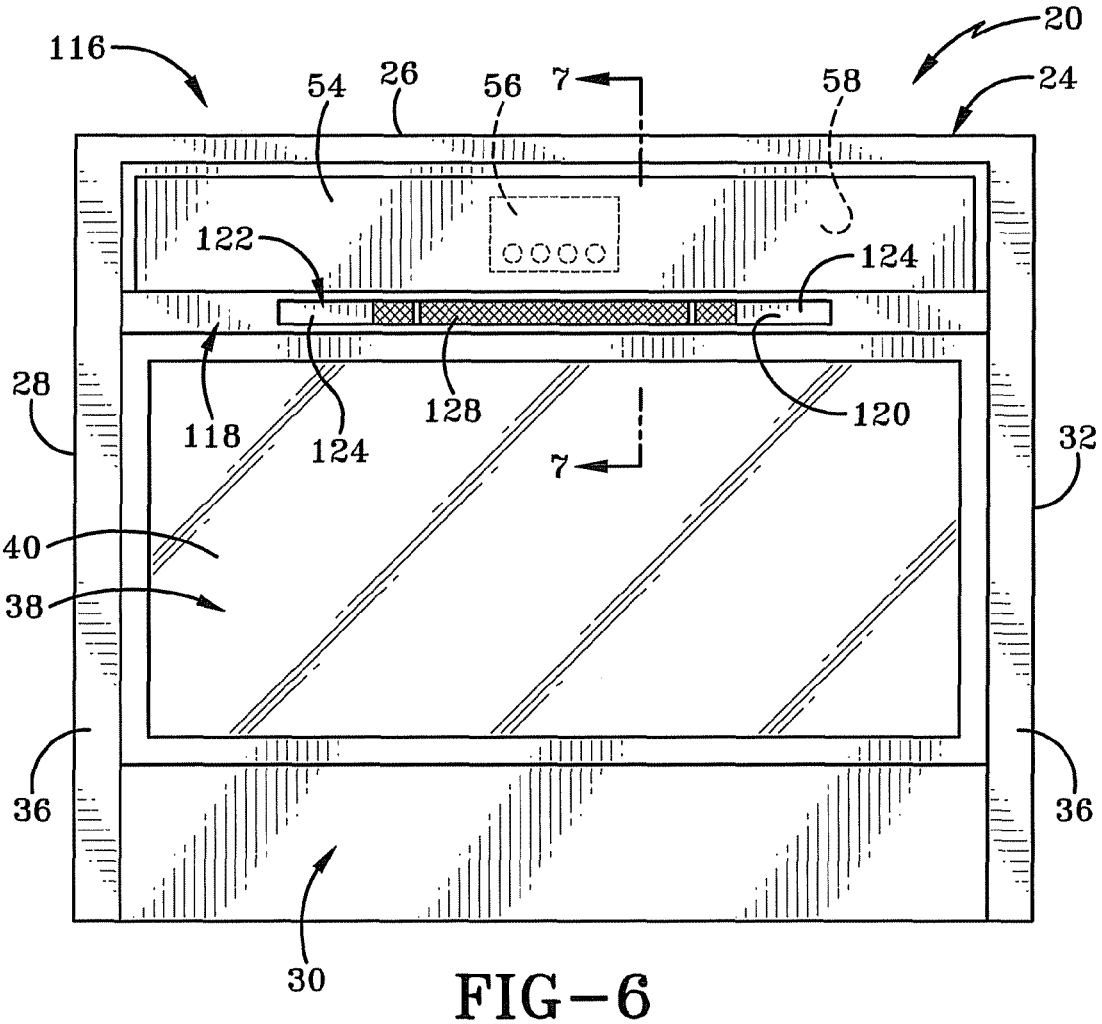
FIG. 6 is a front plan view of a third preferred embodiment fireplace illustrating a protective screen within the outlet duct and the control panel shown in dashed lines.
Figure 7:
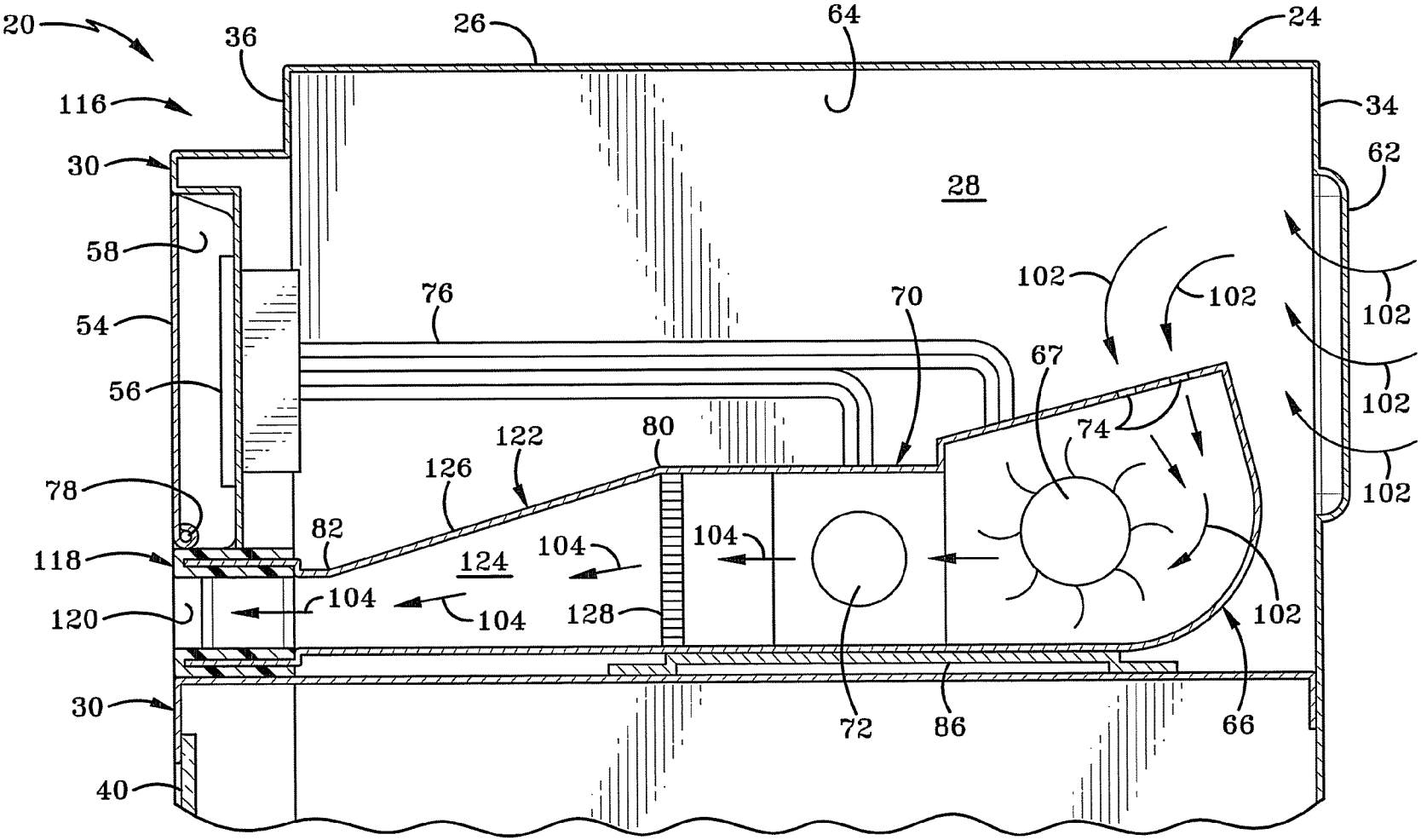
FIG. 7 is a partial cross-sectional view of the third preferred embodiment fireplace taken generally along line 7-7 in FIG. 6 and illustrating a second preferred embodiment air flow path.

FIGS. 6 and 7 illustrate a third preferred embodiment fireplace 116 with an insert 118 having an opening 120. Similar to the first two preferred embodiments, a duct 122 with angled walls 124 directs heated air from blower 67 and heater coil 72 through insert 118. Further, platform 86 is substantially shorter in the third preferred embodiment than the first two preferred embodiments. Accordingly, duct 122 is generally straight and not angled downward similar to previous embodiments, although an upper wall 126 may be angled downward to compensate for any additional height of the heater or blower assembly.

Fireplace 116 also includes a screen 128 located within duct 122 and proximate back end 80. Although screen 128 is shown and described proximate back end 80, it is within the spirit and scope of the present invention as claimed to locate the screen near the front end 82 or any other position within duct 122. Screen 128 remedies the need for an angled duct and prevents foreign objects from entering the duct and reaching the heater coil, thereby increasing the fireplace's safety.

Having described the structure and operation of the first three preferred embodiments, a fourth preferred embodiment will now be described in greater detail. Similar numerals refer to similar parts throughout the various embodiments.

Figure 8:
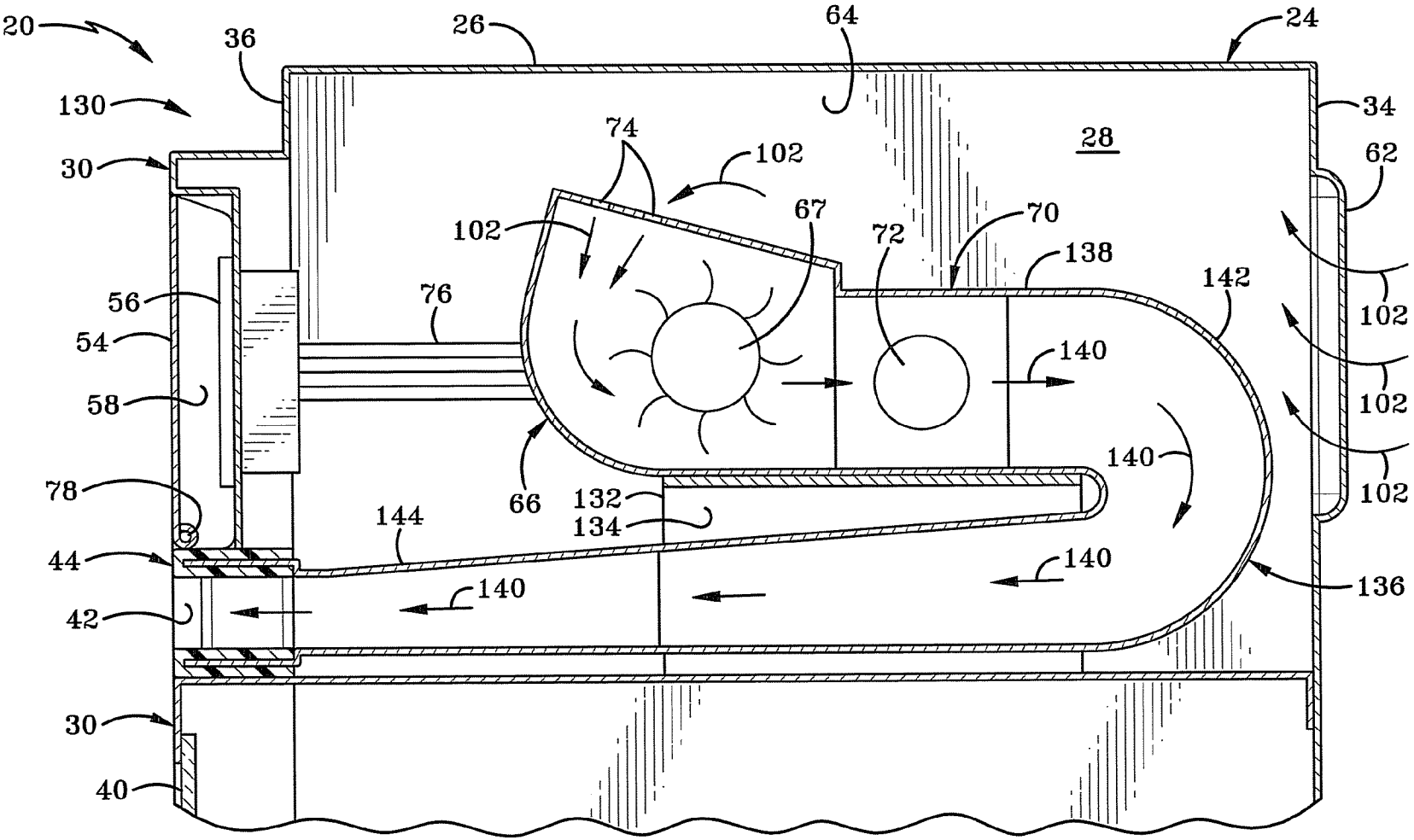
FIG. 8 in a partial cross-sectional view of a preferred embodiment fireplace illustrating a third preferred embodiment air flow path.

FIG. 8 illustrates a fourth preferred embodiment fireplace 130 similar to the first two preferred embodiments. Fireplace 130 includes blower assembly 66 and heater 70 arranged in the opposite direction of the first two preferred embodiments. For example, blower assembly 66 directs ambient air towards the back of the fireplace instead of towards the front of the fireplace. Further, blower assembly 66 and heater 70 sit atop a platform 132 with an opening 134 adapted to receive a duct 136.

A first end 138 of duct 136 preferably connects to heater 70 on platform 132. Duct 136 directs heated air 140 toward the back of the fireplace and into semi-circular section 142 of duct 136 and ultimately into a second end 144 of duct 136 with a decreasing surface area. From second end 144, the fourth preferred embodiment fireplace is similar to the first and second preferred embodiment fireplaces. Advantageously, the semi-circular duct prevents injury to users because an object cannot reach heater coil 72 and provides the same benefits of the angled duct in a more compact arrangement.

Figure 9:
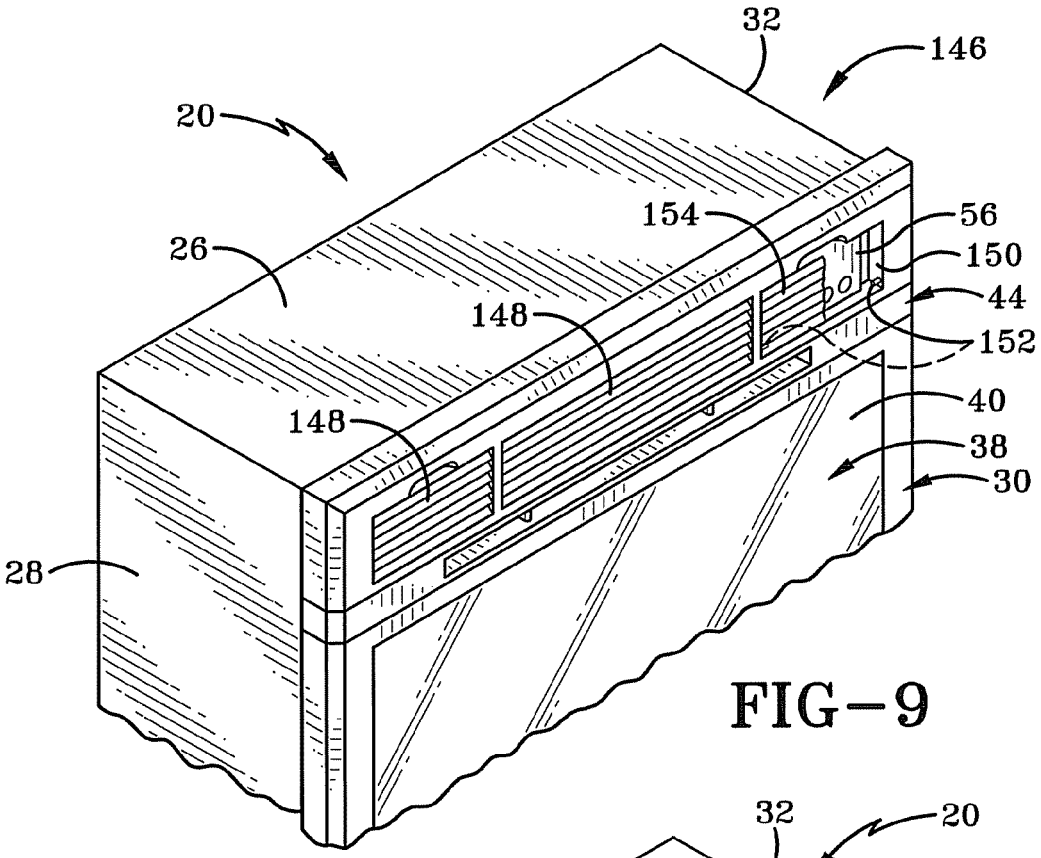
FIG. 9 is a partial perspective view of a preferred embodiment fireplace illustrating a second preferred embodiment control panel location behind a plurality of louvers.
Figure 10:
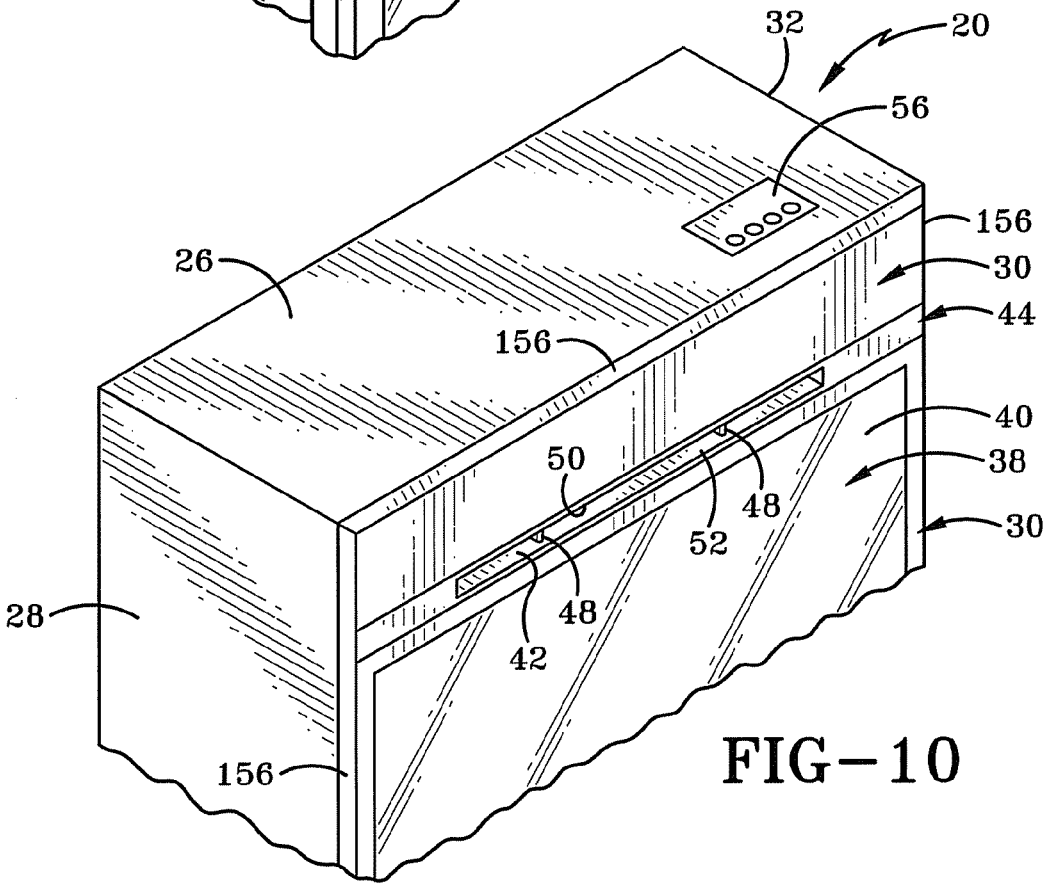
FIG. 10 is a partial perspective view of a preferred embodiment fireplace illustrating a third preferred embodiment control panel location on a top wall.

FIGS. 9 and 10 illustrate alternative locations of control panel 56. For example, FIG. 9 illustrates a fireplace 146 with non-functional louvers 148 located above insert 44. Further, a front compartment 150 includes a pair of pins 152 which permit louvered panel 154 to pivot open and provide access to control panel 56. Thus, this arrangement provides the appearance that the louvers are functional, but provides the additional safety of the cool touch insert to prevent burning the user. Still further, the louvered panel allows the control panel to be hidden when not in use.

FIG. 10 illustrates a third location for control panel 56, namely top wall 26. Control panel 56 may be secured flush with top wall 26 and remedy the need for access panel 54. Accordingly, beveled edges 156 may be incorporated along front wall 30 for an aesthetic appearance. One additional advantage of the third location for control panel 56 is that it permits front wall 30 to have a consistent surface throughout, which may appeal to consumers.

Having described the structure and operation of several preferred embodiments, a fifth preferred embodiment will now be described in greater detail. Similar numerals refer to similar parts throughout the various embodiments.

Figure 11:
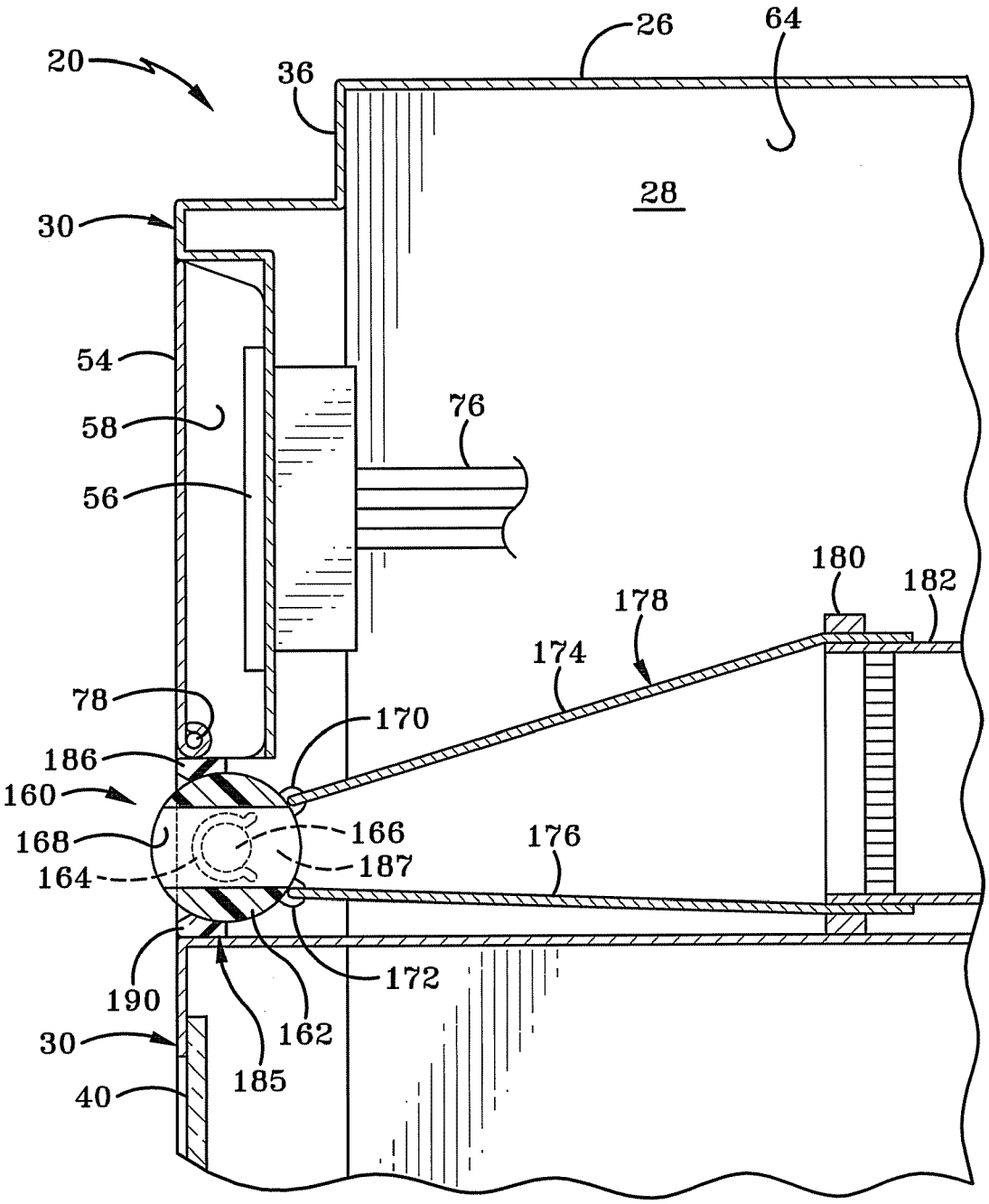
FIG. 11 is a partial cross-sectional view of a preferred embodiment fireplace illustrating a rotatable heated air outlet.
Figure 12:
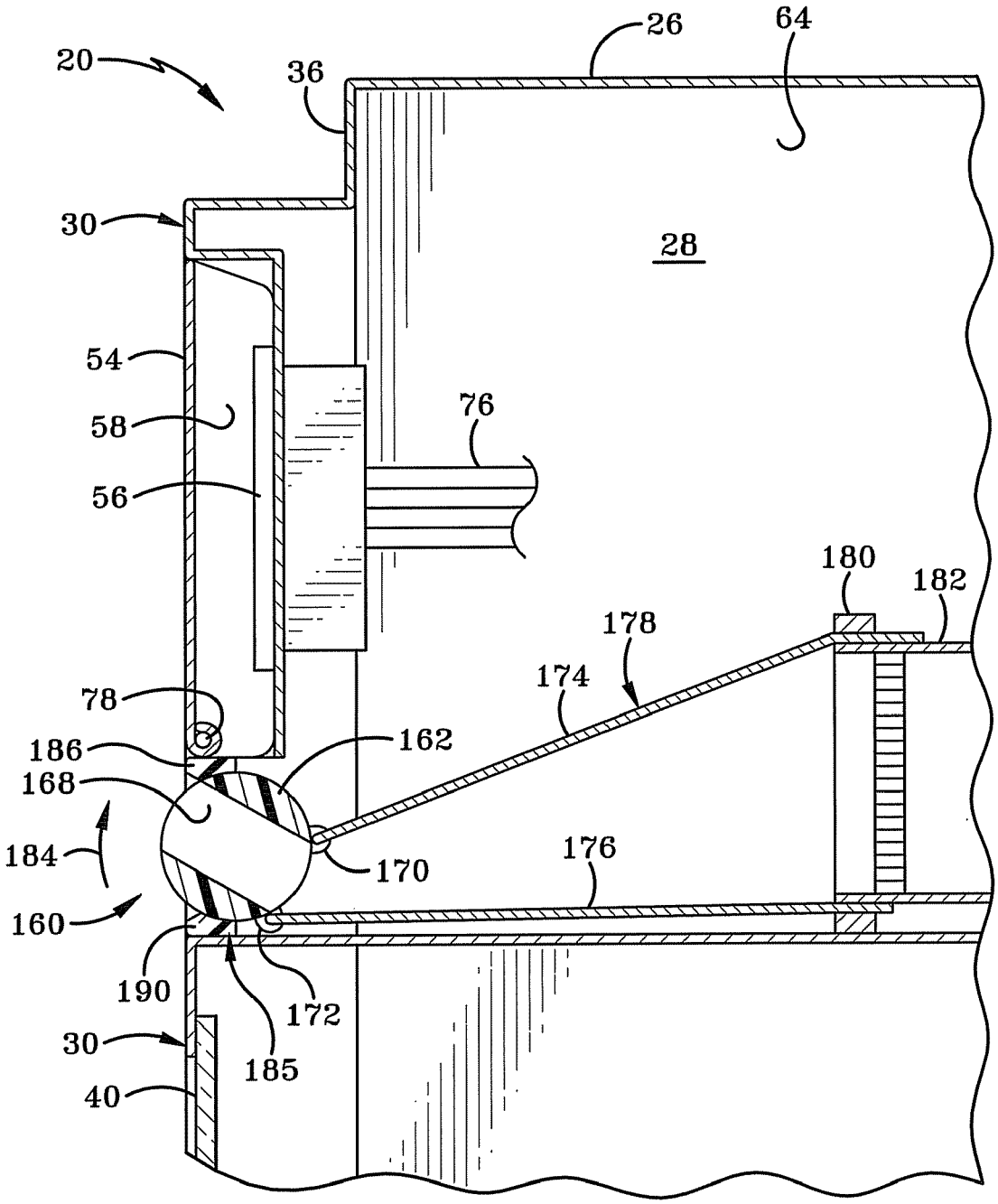
FIG. 12 is a partial cross-sectional view of a preferred embodiment fireplace illustrating the rotatable heated air outlet rotated upward to direct the heated air higher; and, FIG. 13 is a partial cross-sectional view of a preferred embodiment fireplace illustrating the rotatable heated air outlet rotated downward to direct the heated air lower.
Figure 13:
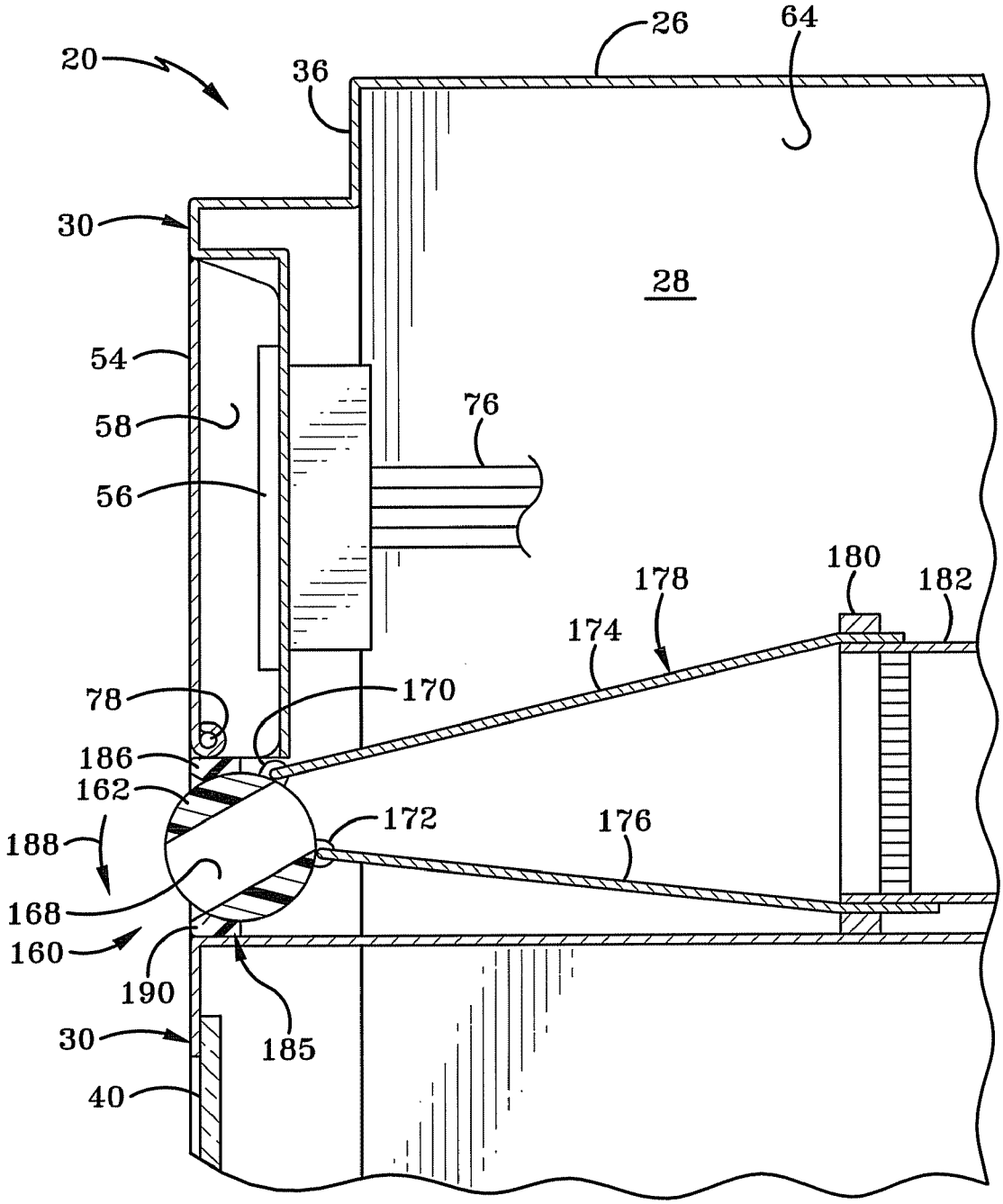

In accordance with still another main feature of the present invention, FIGS. 11, 12, and 13 illustrate the operation of a rotatable outlet 160. Rotatable outlet 160 includes an insert 162 with pins 166 formed in each end. Pins 166 are snap fit into a clip 164 formed in a guide end wall 187. Outlet 160 preferably rotates about pins 166 to provide directional control over the heated air exiting the fireplace through an insert opening 168.

Insert 162 also includes an upper duct mount 170 and a lower duct mount 172 arranged to receive an upper wall 174 and a lower wall 176, respectively. A duct 178 includes upper wall 174, lower wall 176, and a rear duct mount 180 attaching the movable duct to a fixed duct 182. Advantageously, upper wall 174 and lower wall 176 are thin enough to flex during rotation of insert 162 as seen in FIGS. 12 and 13. Although the duct mount is shown as a clamp, any suitable connection type, including welding or fasteners is within the spirit and scope of the present invention as claimed.

FIG. 12 illustrates rotatable outlet 160 being rotated in the direction associated with arrow 184 until insert opening 168 is directed upwards and parallel with a guide 185 and particularly an upper guide wall 186. Guide 185 includes both upper guide wall 186 and a lower guide wall 190. To permit rotation of insert 162 in the direction associated with arrow 184, upper wall 174 and lower wall 176 are forced downward at the end proximate the insert. Thus, the duct operates to direct heated air to the rotatable outlet while still being flexible enough to move as needed.

FIG. 13 illustrates rotatable outlet 160 being rotated in the direction associated with arrow 188 until insert opening 168 is directed downwards and parallel with lower guide wall 190. Once again, to permit rotation of insert 162 in the direction associated with arrow 188, upper wall 174 and lower wall 176 are forced upward at the end proximate the insert. Thus, the duct operates to direct heated air to the rotatable outlet while still being flexible enough to move as needed.

Thus, the fireplaces provide a safe, efficient, and aesthetically pleasing heat source while still permitting maneuverability within a room. In particular, the fireplace can easily heat the room without the danger of burning someone or the risk of electrocution or fire if someone were to insert a foreign object within the fireplace.

Accordingly, the fireplace assembly is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example and the scope of the invention is not limited to the exact details shown or described.

Having now described the features, discoveries, and principles of the invention, the manner in which the fireplace is constructed and used, the characteristics of the construction, and the advantageous new and useful results obtained; the new and useful structures, devices, elements, arrangements, parts, and combinations are set forth in the appended claims.

What is claimed is:

1. A fireplace comprising:

a body;

a heating unit within the body;

a duct within the body and in communication with the heating unit;

an opening defined by a terminal end of the duct;

an insert attached to the terminal end of the duct and arranged to dispel a heated air; wherein the insert is rotatable up to 45 degrees in each of two opposite directions; and the insert remains at a lower temperature than the duct during a heating operation; and wherein the duct pivots when the insert is rotated.

2. The fireplace of claim 1 wherein the opening further comprises a step proximate the terminal end.

3. The fireplace of claim 2 wherein the insert further comprises a rear side adjacent the step.

4. The fireplace of claim 2 wherein the insert further comprises a top side, a bottom side, a left side, and a right side, wherein each side is flush with an inner surface of the duct prior to the step.

5. The fireplace of claim 1 wherein the insert is removably attached within the duct.

6. The fireplace of claim 2 wherein the insert further comprises a passage and the passage is continuous with the duct.

7. The fireplace of claim 1 wherein the insert is recessed within the duct at the terminal end.

8. The fireplace of claim 1 wherein the insert is composed of a plastic.

9. The fireplace of claim 1 wherein the insert remains cooler than the heated air during the heating operation.

10. The fireplace of claim 1 wherein the insert covers an inner surface of the duct.

11. The fireplace of claim 1 wherein the insert covers an inner surface and an outlet end of the duct.

12. The fireplace of claim 1 further comprising a screen disposed within the duct and wherein the screen prevents a foreign object from contacting the heating unit.

13. The fireplace of claim 1 wherein the duct decreases in size from the heating unit to the terminal end.

14. The fireplace of claim 1 wherein the heating unit rests on a platform within the body and the heating unit is located above the opening.

15. The heating unit of claim 14 wherein the duct further comprises a semi-circular bend proximate the heating unit.

16. The fireplace of claim 1 further comprising a plurality of louvers and a log display, wherein the insert is located intermediate the louver and the log display.

17. The fireplace of claim 1 wherein the duct includes a first end and a second end, wherein the first end is secured to the heating unit, the second end is secured to the insert, and the duct flexes at a point between the first end and the second end during rotation of the insert.

18. The fireplace of claim 1 wherein the duct includes a top wall and a bottom wall connected by a pair of side walls and wherein the top wall and the bottom wall pivot when the insert is rotated.

* * * * *